US008814114B2

(12) United States Patent
Baines

(10) Patent No.: US 8,814,114 B2
(45) Date of Patent: Aug. 26, 2014

(54) TENSION WINDOW RODS

(71) Applicant: Maytex Mills, Inc., New York, NY (US)

(72) Inventor: David M. Baines, Bedford, NY (US)

(73) Assignee: Maytex Mills, Inc., New York, NY (US)

( * ) Notice: Subject to any disclaimer, the term of this patent is extended or adjusted under 35 U.S.C. 154(b) by 0 days.

(21) Appl. No.: 14/107,340

(22) Filed: Dec. 16, 2013

(65) Prior Publication Data

US 2014/0103178 A1 Apr. 17, 2014

Related U.S. Application Data

(63) Continuation-in-part of application No. 13/605,783, filed on Sep. 6, 2012, now abandoned.

(60) Provisional application No. 61/664,362, filed on Jun. 26, 2012, provisional application No. 61/874,768, filed on Sep. 6, 2013.

(51) Int. Cl.

| | |
|---|---|
| ***A47H 1/10*** | (2006.01) |
| ***A47H 1/102*** | (2006.01) |
| ***A47H 1/142*** | (2006.01) |
| ***A47H 1/14*** | (2006.01) |
| ***E06B 7/28*** | (2006.01) |
| ***A47H 1/02*** | (2006.01) |

(52) U.S. Cl.

CPC ..... *A47H 1/102* (2013.01); *A47H 1/142* (2013.01); *A47H 1/14* (2013.01); *E06B 7/28* (2013.01); *A47H 1/02* (2013.01)

USPC ..... 248/264; 248/265; 211/105.4; 16/94 D

(58) Field of Classification Search

USPC ..... 248/263, 252, 253, 262, 264, 256, 261, 248/265; 403/44; 211/123, 105.4; 160/126; 16/94 D, 96 D; 4/610

See application file for complete search history.

(56) References Cited

U.S. PATENT DOCUMENTS

| | | | |
|---|---|---|---|
| 647,765 | A | 4/1900 | Schulz |
| 807,886 | A | 12/1905 | Vergason |
| 828,503 | A | 8/1906 | Powell |
| 914,276 | A | 3/1909 | Hopkins |
| 1,049,073 | A | 12/1912 | Gage et al. |
| 1,530,167 | A | 12/1923 | Friend |
| 1,564,747 | A | 12/1925 | Barrett |
| 1,565,123 | A | 12/1925 | Trager |
| 1,668,140 | A | 5/1928 | Buchheit |
| 1,802,303 | A | 4/1931 | Zalewski |
| 1,951,660 | A | 3/1934 | Klaudt |
| 2,032,842 | A | 3/1936 | Gould |

(Continued)

*Primary Examiner* — Bradley Duckworth

(74) *Attorney, Agent, or Firm* — Robert P. Lenart, Esq.; Pietragallo Gordon Alfano Bosick & Raspanti, LLP

(57) ABSTRACT

A window rod assembly includes two support arm assemblies each including a bracket, a support arm having a first end rigidly connected to the bracket, and a tube rigidly connected to a second end of the support arm; a curtain rod including a first rod section and a second rod section configured in a telescoping arrangement and sized to fit into the tubes of the support arm assemblies; a locking mechanism for securing the relative axial position of the first rod section with respect to the second rod section; and a force adjusting mechanism mounted on at least one of the support arm assemblies and configured to apply an inward force to the curtain rod at a location within the first tube and an outward force to the support arm assemblies to force the brackets into support surfaces of a window opening or window casing.

11 Claims, 13 Drawing Sheets

(56) References Cited

U.S. PATENT DOCUMENTS

| | | | |
|---|---|---|---|
| 2,151,223 | A | 3/1939 | Nayman, Sr. |
| 2,234,099 | A | 3/1941 | Westfall et al. |
| 2,293,168 | A | 8/1942 | Pirone |
| 2,449,597 | A | 8/1948 | Ferrenberg |
| 2,474,434 | A | 6/1949 | Mentz |
| 2,492,517 | A | 12/1949 | Bernick |
| 2,637,555 | A | 5/1953 | Klaudt |
| 2,725,989 | A | 12/1955 | Burkey |
| 2,813,733 | A | 11/1957 | Herrmann |
| 3,060,490 | A | 10/1962 | Saito |
| 3,166,286 | A | 1/1965 | Pfaff |
| 3,946,978 | A | 3/1976 | Evans |
| 4,684,095 | A | 8/1987 | Athey |
| 4,754,504 | A | 7/1988 | Cellini |
| 4,895,471 | A | 1/1990 | Geltz et al. |
| 5,011,030 | A | 4/1991 | Alaurent |
| 5,113,588 | A | 5/1992 | Walston |
| 5,810,302 | A | 9/1998 | McCance |
| 6,694,543 | B2 | 2/2004 | Moore |
| 6,715,163 | B1 | 4/2004 | Cunningham |
| 7,431,067 | B2 | 10/2008 | Nien |
| 8,056,873 | B1 | 11/2011 | Hanley et al. |
| 2004/0182806 | A1 | 9/2004 | Figueroa |
| 2008/0028513 | A1 | 2/2008 | Didehvar |
| 2009/0223917 | A1 | 9/2009 | Grant et al. |
| 2010/0181445 | A1 | 7/2010 | Goldstein |
| 2011/0031198 | A1 | 2/2011 | Trettin et al. |
| 2012/0005823 | A1 | 1/2012 | Baines |
| 2012/0110729 | A1 | 5/2012 | Baines |
| 2012/0261371 | A1 | 10/2012 | Baines |
| 2013/0099080 | A1 | 4/2013 | Baines |
| 2013/0112639 | A1 | 5/2013 | Baines |

TENSION WINDOW RODS

CROSS-REFERENCE TO RELATED APPLICATIONS

This application is a continuation-in-part of U.S. patent application Ser. No. 13/605,783, filed Sep. 6, 2012, titled "Gripper Window Rod", which claims the benefit of U.S. Provisional Patent Application Ser. No. 61/664,362, filed Jun. 26, 2012, titled "Gripper Window Rod", which are incorporated herein by reference. This application also claims the benefit of U.S. Provisional Patent Application Ser. No. 61/874,768 filed Sep. 6, 2013, and titled "Decorative Tension Window Rods", which is incorporated herein by reference.

FIELD OF THE INVENTION

This invention relates to window rods.

BACKGROUND

Decorative window rods generally include a rod with a decorative finial at each end. Some support means is provided to hold the rod in a desired position in front of a window. Conventional window curtain rods are mounted adjacent to a window by being screwed into the wall or window casing. The installation of window curtain rods can be time consuming. In addition to being tedious, it can be difficult to align the brackets. The installations are permanent and walls or casing can be damaged in the process. For rental properties and student dorms, the damage caused by the screws is a significant issue and a deterrent to installation.

It would be desirable to overcome the cumbersome installation associated with conventional decorative tension window rods.

SUMMARY

In one aspect, a window rod assembly includes a first support arm assembly including a first bracket, a first support arm having a first end rigidly connected to the first bracket, and a first tube rigidly connected to a second end of the first support arm; a second support arm assembly including a second bracket, a second support arm having a first end rigidly connected to the second bracket, and a second tube rigidly connected to a second end of the second support arm; a curtain rod including a first rod section and a second rod section configured in a telescoping arrangement with a portion of the first rod section being sized to fit into the first tube and a portion of the second rod section being sized to fit into the second tube; a locking mechanism for securing the relative axial position of the first rod section with respect to the second rod section; and a force adjusting mechanism mounted on the first support arm assembly and configured to apply an inward force to the curtain rod at a location within the first tube and an outward force to the first and second support arm assemblies to force the first and second brackets into support surfaces of a window opening or window casing.

DETAILED DESCRIPTION

In one aspect, the present invention provides window rods that are faster and easier to install in comparison with conventional window rods. The described embodiments provide window rod assemblies that use tension forces to mount the rod in the window opening. No screws or glue are necessary.

Figure 1:
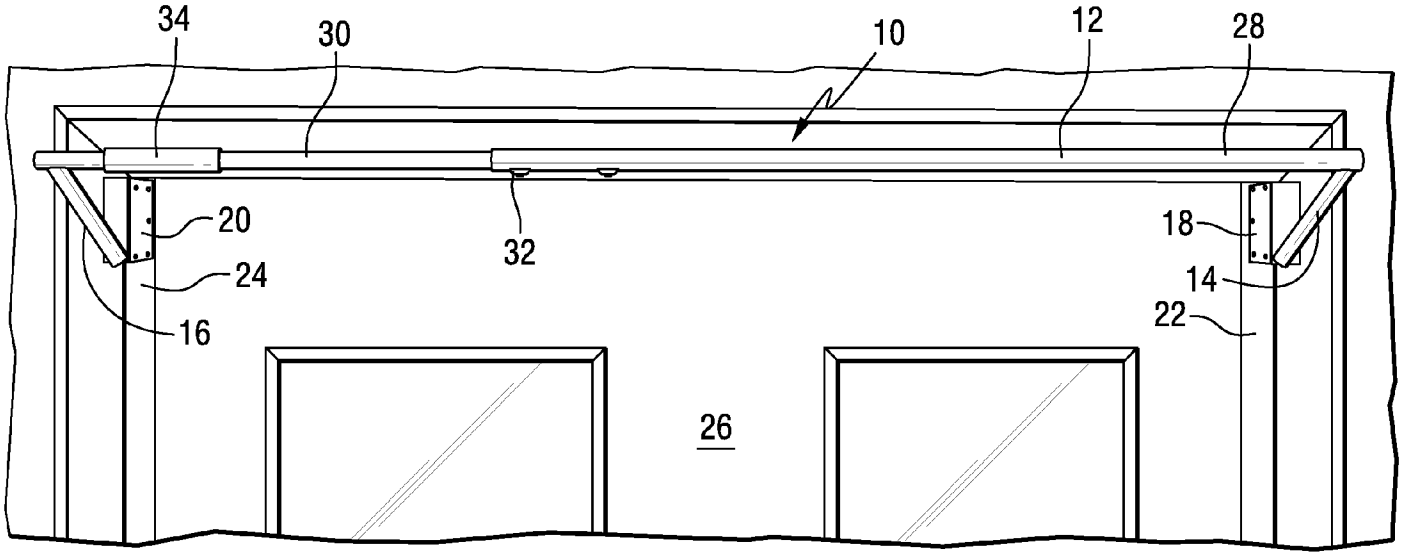
FIG. 1 shows a window rod assembly constructed in accordance with an embodiment of the invention.

Referring to the drawings, FIG. 1 shows a window rod assembly 10 constructed in accordance with an embodiment of the invention. The window rod assembly is suitable for mounting in a window opening and includes an adjustable support rod 12 extending between two arms 14, 16. Each arm is rigidly attached to an end bracket 18, 20. The ends of the support rod 12 are rigidly connected to the ends of the arms 14, 16 that extend from the brackets toward an interior of the room, i.e., away from the window opening.

The end brackets are configured to be mounted adjacent to opposing interior walls 22, 24 of a window opening 26. The adjustable support rod includes first and second rod sections 28, 30 configured in a telescoping arrangement. One of the first and second rod sections is configured to slidably fit into the other rod section. A locking device (also called a fastening means) 32 is provided to fix the relative position of the first and second rod sections with respect to each other. While the first and second rod sections 28, 30 have a circular cross-sectional shape in this embodiment, rod sections having other cross-sectional shapes may also be used. A force adjusting mechanism 34 (also called a tension adjusting assembly) is positioned in at least one of the support rod sections. When the rod assembly is mounted in a casement window opening 26, the force adjusting assembly is used to force the rod sections apart. Since the rod sections are rigidly connected to the ends of forward extending arms that are rigidly connected to the end brackets, the end brackets are forced against opposing walls 22, 24 of the window opening. This action secures the position of the end brackets with respect to the walls of the window opening or to a casement of the window opening.

Figure 2:
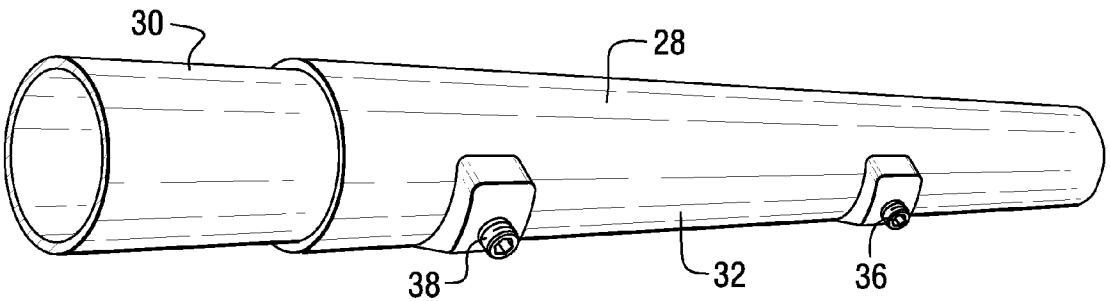
FIG. 2 is a close up view of a fastener assembly for the window rod assembly of FIG. 1.

FIG. 2 is a close up view of the locking device 32 for the adjustable support rod of FIG. 1. The first rod section 28 has an inner diameter that is slightly larger than the outer diameter of the second rod section 30, allowing the second rod section to slide within the first rod section. Fasteners, which may comprise allen screws 36, 38, pass through the wall of the first rod section and make contact with the wall of the second rod section. The thickness of the wall of the first rod section in the vicinity of the screws is increased to allow for an increase in the engagement length between the screws and the wall of the first rod section. With this fastening means, the length of the support rod can be adjusted in a continuous manner. The screws fix the relative position of the rod sections in a secure manner to withstand axial forces that are applied when the force adjusting assembly is used to force the brackets against the walls of the window opening.

Figure 3:
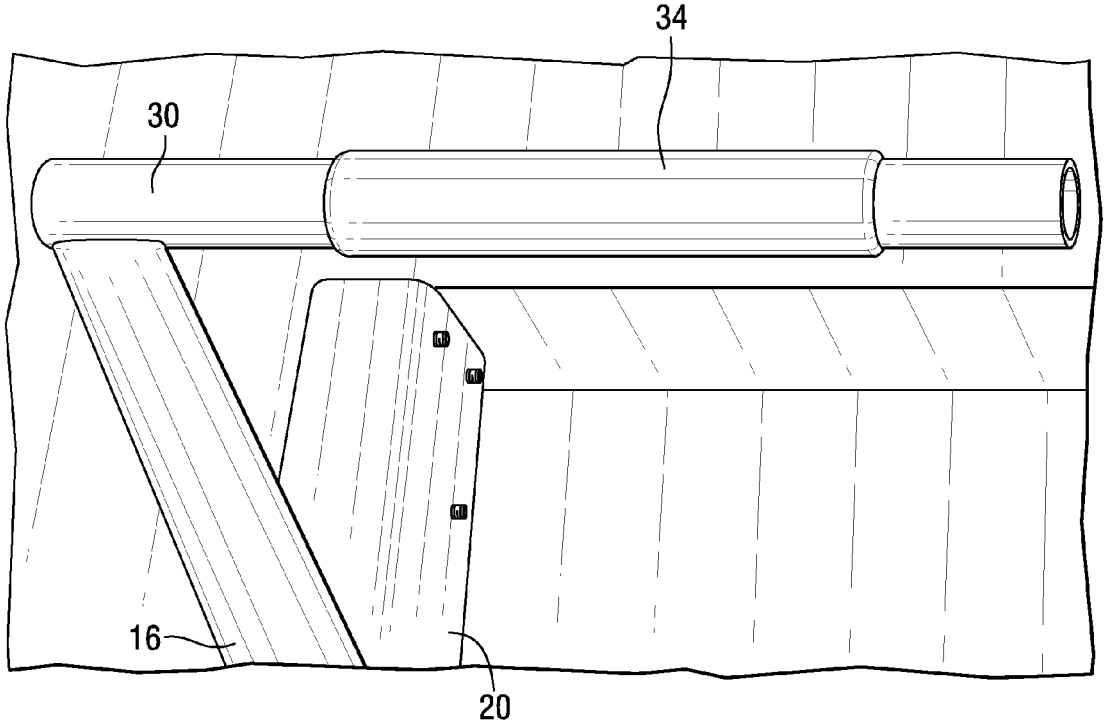
FIG. 3 is a side view of a force adjusting assembly that can be used in the window rod assembly of FIG. 1.

FIG. 3 is a close up view of the second section 30 of the support rod of FIG. 1. FIG. 3 shows a tension adjusting mechanism 34 that is positioned in the first telescoping section 30.

Figure 4:
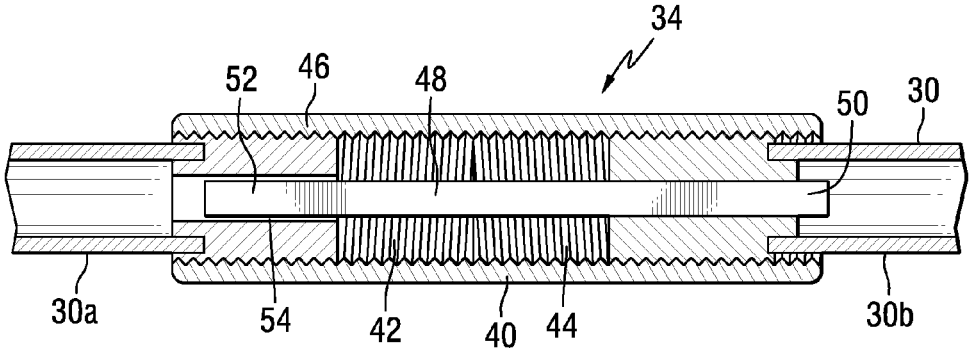
FIG. 4 is a schematic cross-sectional view of the force adjusting assembly of FIG. 3.

FIG. 4 is a schematic representation of the tension adjusting mechanism 34, also called a tension adjuster or tension adjusting assembly. The tension adjusting assembly includes a sleeve 40 having internal threads. The sleeve is positioned over first and second threaded sections 42, 44 of parts 30*a* and 30*b* of the second rod section 30. Threads in the first and second threaded sections are reversed with respect to each other. The internal threads 46 of the sleeve engage the first and second threaded portions of the second rod section. By rotating the sleeve, the parts of the support rod are forced apart, thereby forcing the end brackets against the opposing interior walls of the window opening as described above. An alignment rod 48 extends between the two threaded sections. One end 50 of the alignment rod is fixed in part 30*b*, and the other end 52 of the alignment rod is in a slot 54 in part 30*a*.

Figure 5:
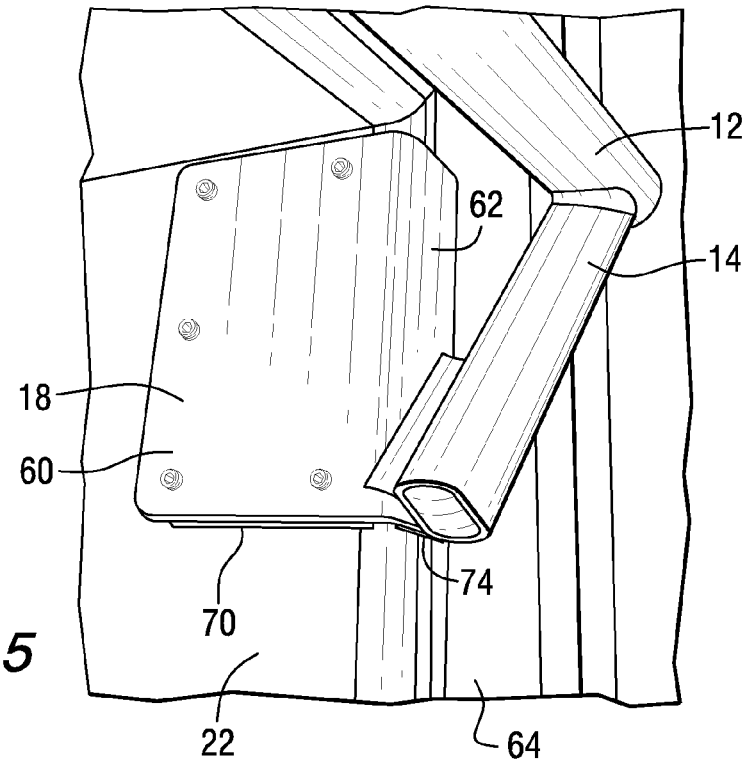
FIG. 5 is a close up view of one end bracket of the window rod assembly of FIG. 1.

FIG. 5 is a perspective view of the end bracket 18 of the window rod assembly of FIG. 1. End bracket 18 includes a first part 60 and a second part 62. The first part 60 is configured to be positioned adjacent to the interior wall 22 of the window opening or casing. The second part 62 is configured to be positioned adjacent a casing 64 or wall adjacent to the window opening if there is no casing at the location of the bracket.

Figure 6:
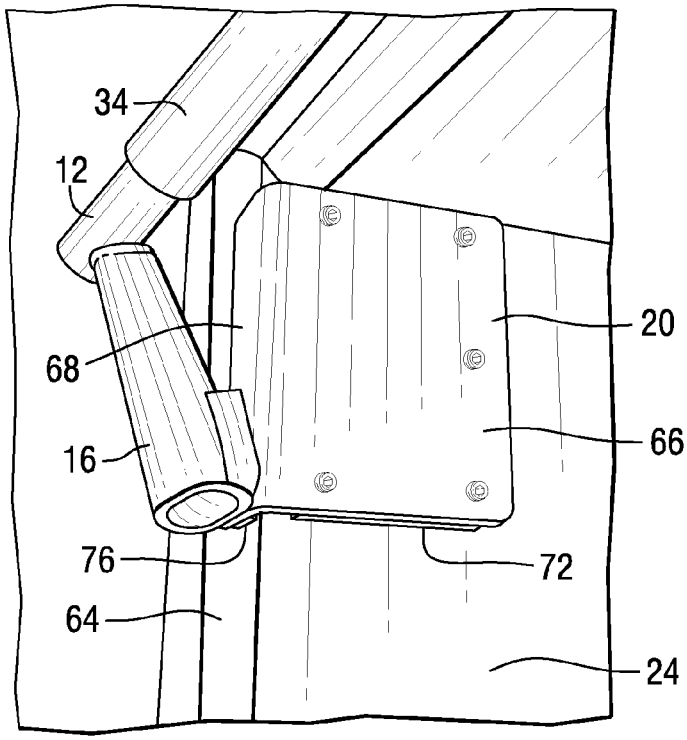
FIG. 6 is a close up view of another end bracket of the window rod assembly of FIG. 1.

FIG. 6 is a perspective view of the end bracket 20 of the window rod assembly of FIG. 1. End bracket 20 includes a first part 66 and a second part 68. The first part 66 is configured to be positioned adjacent to the interior wall 24 of the opening or casing. The second part 68 is configured to be positioned adjacent a casing 64 or wall adjacent to the window opening if there is no casing at the location of the bracket.

The second part of each end bracket is configured to be mounted adjacent a casing 64 or wall adjacent to the window opening. This configuration resists twisting forces applied to the bracket due to the weight of the support rod and a curtain mounted on the support rod. Resilient pads 70, 72, which in one example are rubber pads, can be positioned between the first part of the end brackets and the interior walls 22, 24 of the interior window opening. Resilient pads 74, 76, which in one example are rubber pads, can be positioned between the second part of the end brackets and the walls or casing 36 adjacent to the window opening.

The arms are rigidly attached to both the end brackets and the support rod, such that when the support rod is lengthened, the first parts of the brackets are forced into the interior walls of the window opening, which form support surfaces for the window rod assembly. For example, the arms can be welded to the end brackets and the support rod. In the illustrated embodiment, the arm extends from the second part of the end brackets in a forward and upward direction. The end brackets can be constructed of two plates positioned in planes that are at a substantially right angle with respect to each other. In FIG. 1, a casing is provided adjacent to the top edge of the casement window opening and adjacent to the sides on the window opening, and second part of the end brackets is shown to be positioned adjacent to the casing. However, where a casing is not used, the second parts of the end brackets can be positioned adjacent to a wall that is adjacent to the window opening.

To mount the window rod assembly to a window opening, the length of the support rod is adjusted by sliding the rod sections with respect to each other until the first parts of the brackets are adjacent to the walls of the window opening. In addition, the second parts of the brackets are positioned adjacent to the forward facing wall or casing next to the window opening. Then the fastener is tightened to secure the first and second sections of the support rod in a fixed position relative to each other in an axial direction. Next, the tension adjusting assembly is adjusted to lengthen the support rod and force the end brackets into the opposing walls of the opening.

Figure 7:
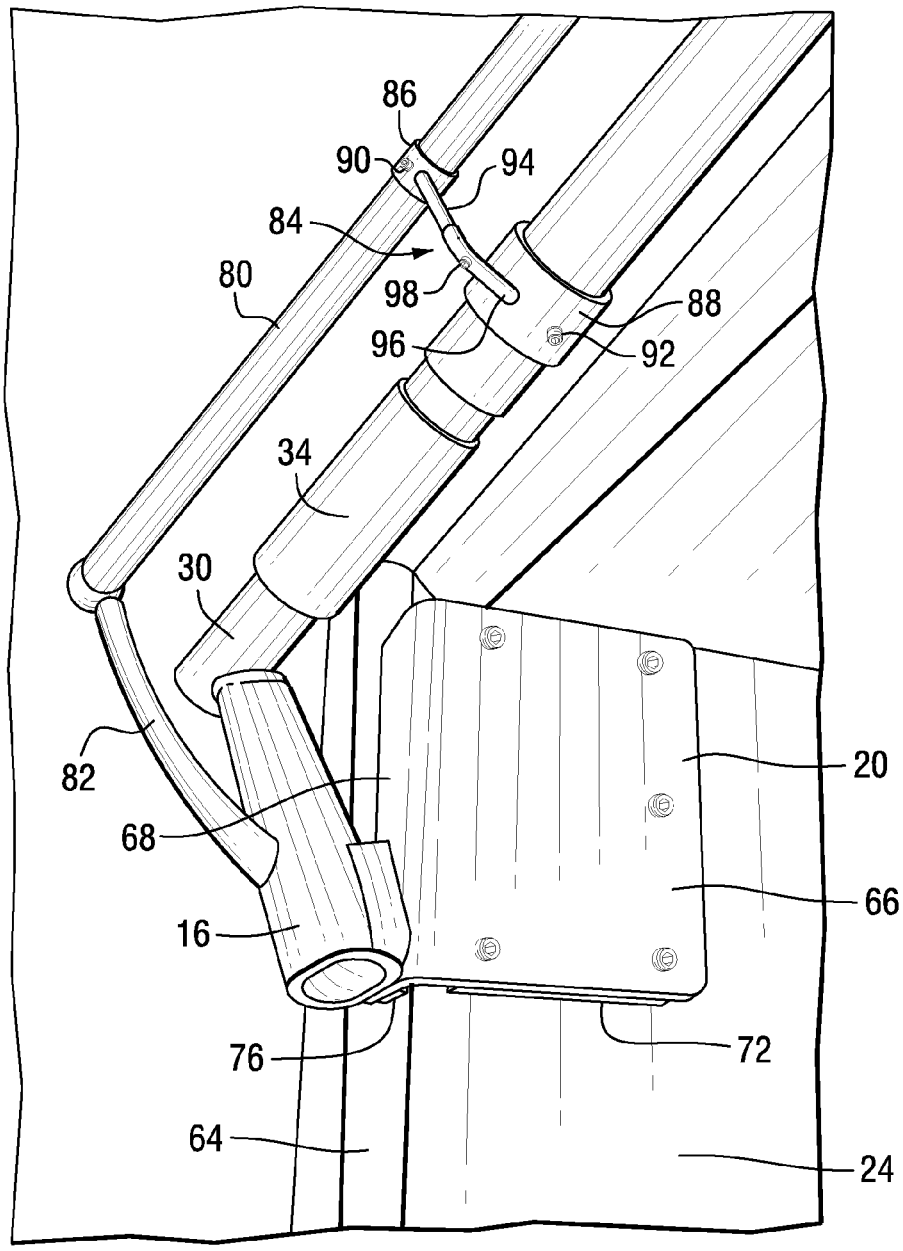
FIG. 7 is a close up view of a portion of another embodiment of the window a rod assembly.

FIG. 7 is a close up view of a portion of a two rod embodiment of a window rod assembly. The embodiment of FIG. 7 includes the elements of FIGS. 1-6 and further includes a second support rod 80. The second support rod is connected to an arm 82. The arm 82 can be connected to arm 16 either in a fixed position, or with a connection that allows for relative movement of arms 16 and 82. Alternatively, arm 82 could be attached directly to the end bracket 20 either in a fixed position, or with a connection that allows for relative movement of arm 82 with respect to the end bracket. In addition, another arm can be positioned adjacent to another end of the support rod 80 and the other arm can be coupled to arm 14 or end bracket 18 in a manner similar to that described for arm 82. An adjustable bracket 84 is shown between support arms 12 and 82. The bracket includes rings 86, 88 that are sized to fit around rods 12 and 80. Locking means, which can be, for example, screws 90 and 92 or other fasteners, are provided to fix the position of the rings with respect to the rods. The bracket further includes two shafts 94, 96 that are connected to the rings and engage each other in a telescoping arrangement. For example, in this embodiment, shaft 94 can be inserted into shaft 96 and the relative positions of the shafts can be secured with a fastener, such as a screw 98. Support rod 80 can include a tension adjuster that can be similar to tension adjuster 34. The support rod 80 can further include two telescoping sections and a fastener for maintaining a fixed spatial relationship between the first and second telescoping sections, similar to those described for support rod 12 above.

Figure 8:
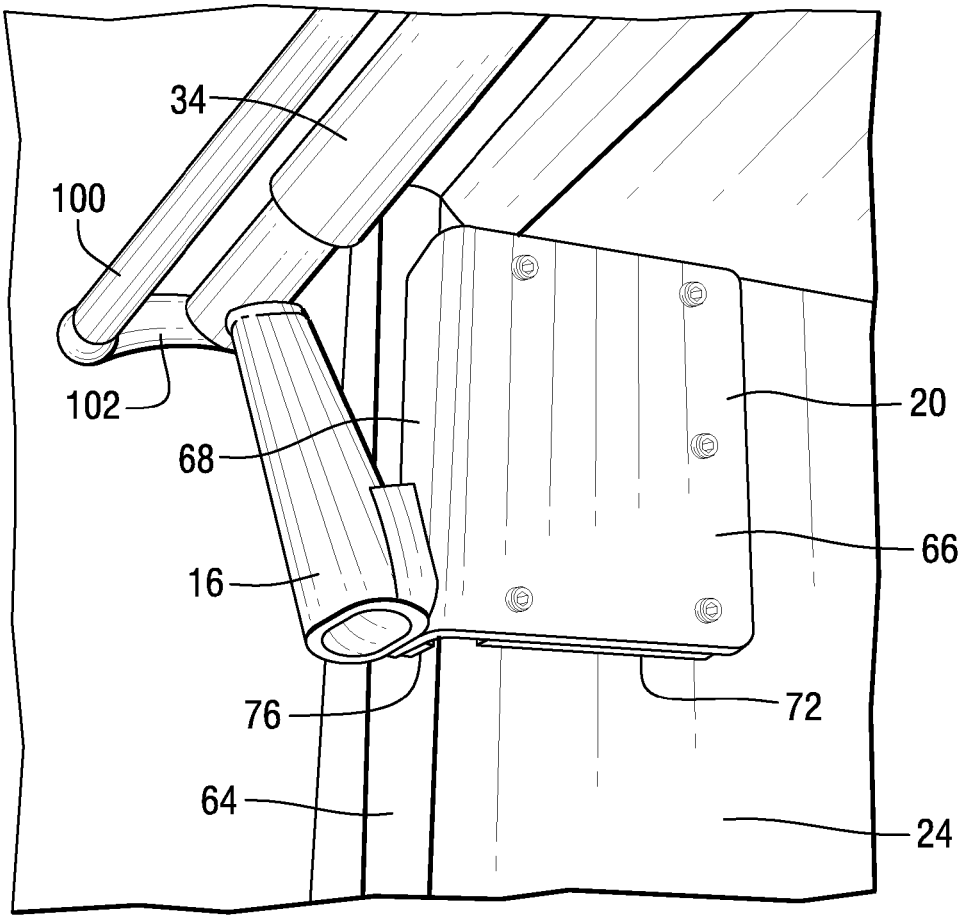
FIG. 8 is a close up view of a portion of another embodiment of a window rod assembly.

FIG. 8 is a close up view of a portion of another two rod embodiment of a window rod assembly. The embodiment of FIG. 8 includes the elements of FIGS. 1-6 and further includes a second support rod 100. The second support rod is connected to a bridge 102. The bridge 102 can be connected to arm 16 either in a fixed position, or with a connection that allows for relative movement of arm 16 and bridge 102. In addition, another bridge can be positioned adjacent to another end of the support rod 80 and the other bridge can be coupled to arm 14 or end bracket 18 in a manner similar to that described for bridge 102. An adjustable bracket similar to that shown in FIG. 7 can be positioned between support rods 12 and 100. Support rod 100 can be a second rod section, similar to support rod 12 and can include a fastener and tension adjuster that can be similar to fastener 32 and tension adjuster 34.

Using allen key type screws or other fasteners to fix the relative position of the telescoping sections of the support rod, and a tension adjuster, the brackets of the window rod assembly can be rigidly set inside and near the top of a window casement. In one embodiment, each end of the support rod is connected to an arm that is connected to a bracket with rubber on the inside which grips onto the inside of the window frame. This reduces the possibility of damaging the window opening walls and supplies additional holding power. The support rod includes a tension adjuster which can be tightened to rigidly fix the rod into its desired position.

Figure 9:
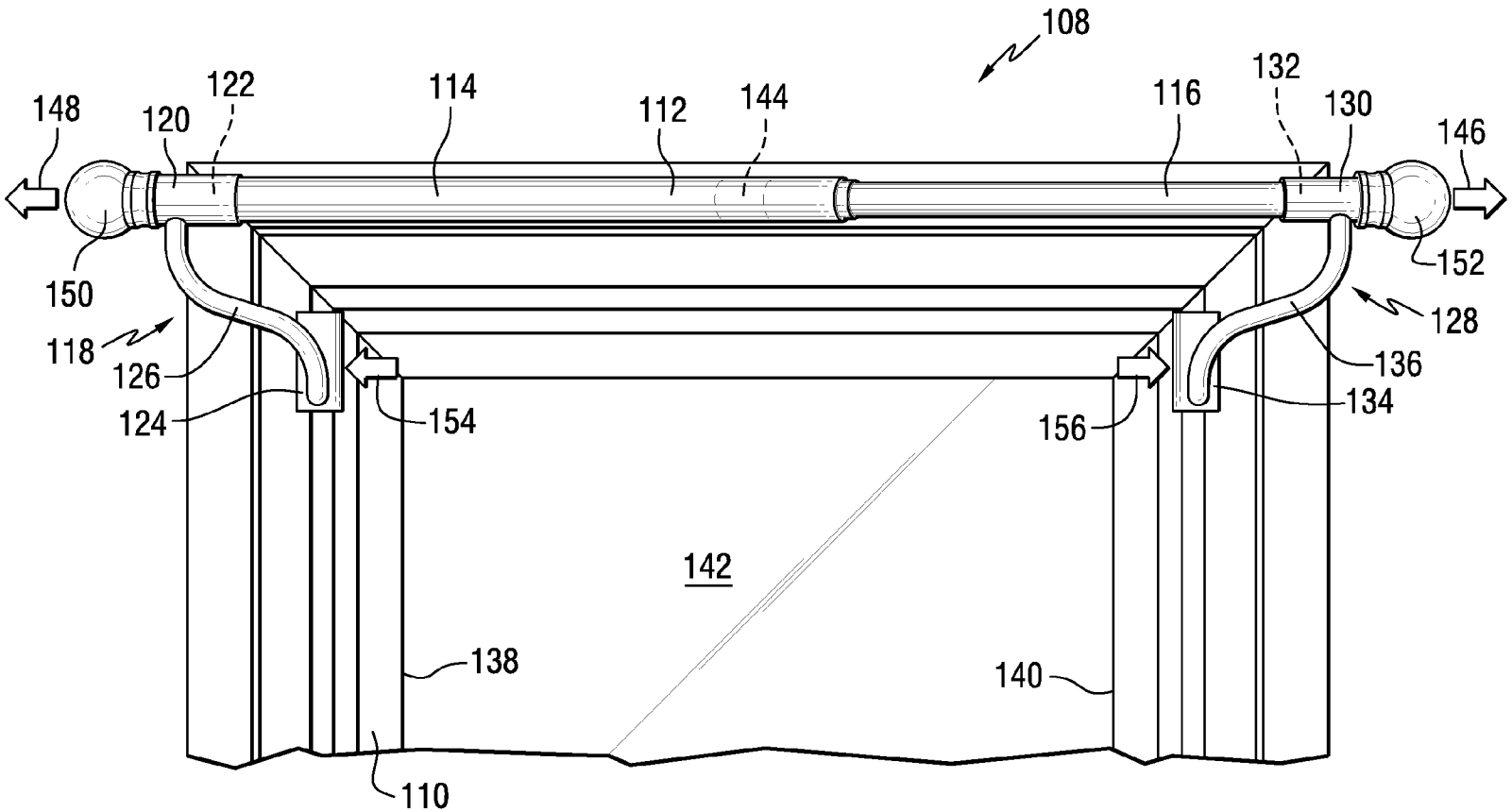
FIG. 9 is a front view of a window rod in accordance with another embodiment of the invention.

FIG. 9 is a front view of a window rod assembly 108 in accordance with another embodiment of the invention, mounted in a window casing 110. The window rod includes a rod 112 having a first section 114 and a second section 116. The first and second rod sections are configured in a telescoping arrangement such that a portion of the first section is configured to slide into a portion of the second section. A locking device 144 (also called a fastening device or fastening means) is provided to fix the axial position of the first section with respect to the second section. In one embodiment described below, the locking device is mounted on rod section 116 and includes a cam and eccentric element configured such that rotation of one of the rod sections with respect to the other will lock the rod sections together. This fixes the axial position of the rod sections with respect to each other.

A first support arm assembly 118 is provided near an outer end of the first rod section. The first support arm assembly includes a first sleeve or tube 120 configured to engage a portion 122 of the first rod section, a first bracket 124, and a first arm 126 extending between the first sleeve and the first bracket. A second support arm assembly 128 is provided near an outer end of the second rod section. The second support arm assembly includes a second sleeve or tube 130 configured to engage a portion 132 of the second rod section, a second bracket 134, and a second arm 136, extending between the second sleeve and the second bracket. As described in more detail below, at least one of the first and second support arm assemblies includes a tension adjuster that is configured to apply a force on the support rod in an axial direction and spread the support brackets. This urges the first and second brackets against interior surfaces 138, 140 of a window opening 142.

The rod assembly includes a locking device 144, which in this embodiment is coupled to the second rod section that is positioned inside the first rod section. The locking device includes an axially offset cam and an eccentric sleeve around the cam, such that when the second rod is rotated with respect to the first rod section, the eccentric sleeve pushes against an internal surface of the first rod section, thereby locking the axial position of the first rod section with respect to the second rod section. To install the rod assembly, the brackets are positioned adjacent to the interior surfaces of the window opening and the first and second rod sections are pulled apart until the brackets make contact with the internal walls of the window opening. Then the rod sections are rotated with respect to each other to lock that axial position of the first and second rod sections with respect to each other. Then a force is applied to the rod as shown by arrows 146 and 148 using a force adjusting mechanism (also called a tension adjuster, described in more detail below) coupled to at least one of the finials 150, 152. Because the arms 126 and 136 are rigidly attached to the brackets 124 and 134 and rigidly attached to tubes 120 and 130, an outward force as indicated by arrows 154 and 156 is also applied to the brackets 124 and 134. This outward force pushes the brackets into the internal surfaces (i.e., the support surfaces) of the window opening, thus securing the rod assembly to the window opening. Since portions of the support rod extend into tubes 120 and 130, and the inner diameter of the tubes is close to the outer diameter of the rod portions that extend into the tubes, when the tension force is applied to the support rod, movement of the support assemblies port with respect to the support rod is limited to the axial direction. Thus an outward force is applied to brackets to secure the brackets to the support surfaces. Since the ends of the rods are slideably positioned in the tubes of the support arm assemblies, movement of the rod in any direction other than axially along the tubes is prevented. With the configuration shown in FIGS. 1 and 9, forces applied to the support rod are transferred to the brackets. Thus there is no need for any additional means for attaching the brackets to the walls of the window opening or the window casing.

The support arms are shaped to extend forward toward the interior of the room and also outward with respect to the window opening. This positions the support rod away from the window opening and any casing that might be positioned around the window opening.

Figure 10:
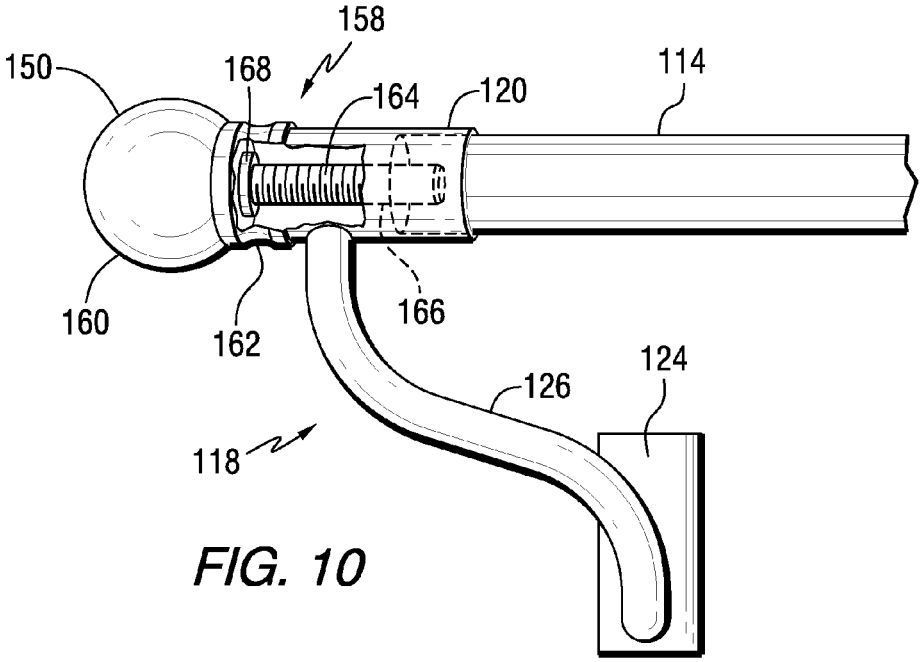
FIG. 10 is an isometric view of the right support assembly of the window rod of FIG. 9.

FIG. 10 is an isometric view partially in section, of a force adjusting mechanism 158 that can be included in the first support arm assembly. In this embodiment, the finial 150 is shown to include a generally spherical portion 160 connected to a collar 162 that is connected to the tube 120. A threaded stud 164 extends from the finial into a threaded opening 166 of the rod section 114. The threaded stud is held in place with respect to the tube by a nut 168, or other restraining means such as a washer or collar, that allows the stud to rotate within the tube but prevents the stud from moving in an axial direction with respect to the tube. The stud is also coupled to the finial in a manner such that rotation of the finial causes the stud to rotate, alternatively pulling the rod section toward the finial or pushing the rod section away from the finial. Pushing the rod section away from the finial places an inward or compressive force on the rod in the axial direction and consequently places an outward force on the support arm assemblies. This forces the brackets into the support walls and secures the position of the window rod assembly with respect to the window opening.

Figure 11:
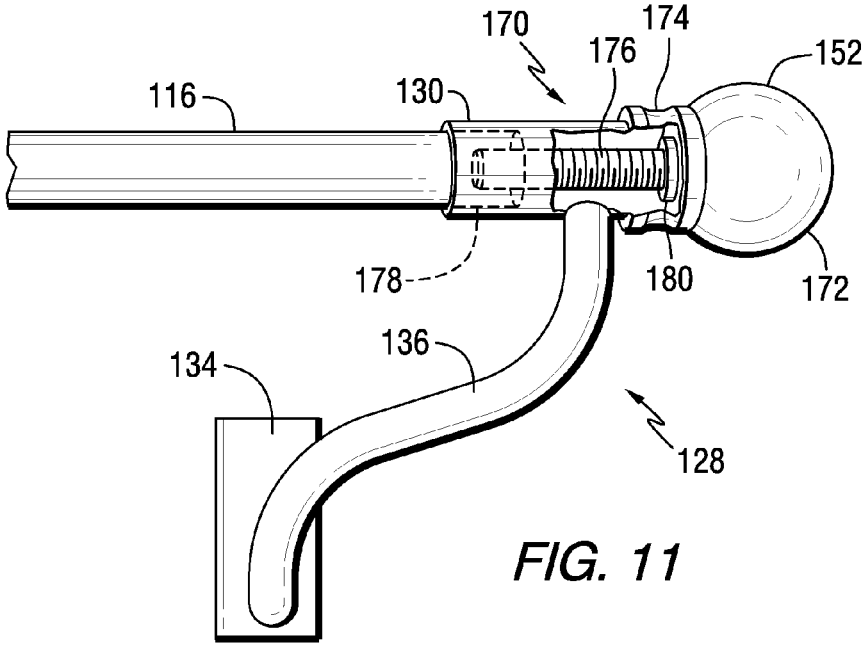
FIG. 11 is an isometric view of the left support assembly of the window rod of FIG. 9.

FIG. 11 is an isometric view partially in section, of another force adjusting mechanism 170 that can be included in the second support arm assembly. In this embodiment, the finial 152 is shown to include a generally spherical portion 172 connected to a collar 174 that is connected to the tube 130. A threaded stud 176 extends from the finial into a threaded opening 178 of the rod section 116. The threaded stud is held in place with respect to the tube by a nut 180, or other restraining means such as a washer or collar, that allows the stud to rotate within the tube but prevents the stud from moving in an axial direction with respect to the tube. The stud is also coupled to the finial in a manner such that rotation of the finial causes the stud to rotate, alternatively pulling the rod section toward the finial or pushing the rod section away from the finial. Pushing the rod section away from the finial places an inward or compressive force on the rod in the axial direction and consequently places an outward force on the support arm assemblies. This forces the brackets into the support walls and secures the position of the window rod assembly with respect to the window opening.

Figure 12:
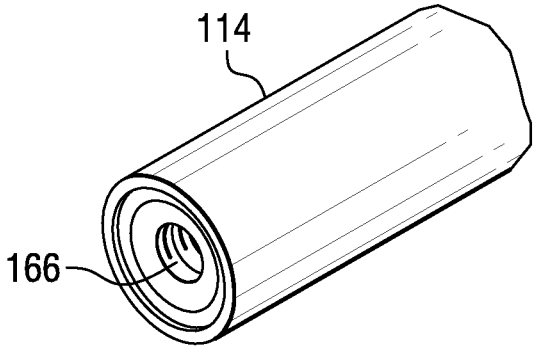
FIG. 12 is a schematic view of elements of a tensioner that in combination with the right support assembly of the window rod of FIG. 9.

FIG. 12 is an isometric view of an outer end of the rod section 114, showing the threaded opening 166. A similar opening is located at the outer end of rod section 116.

Figure 13:
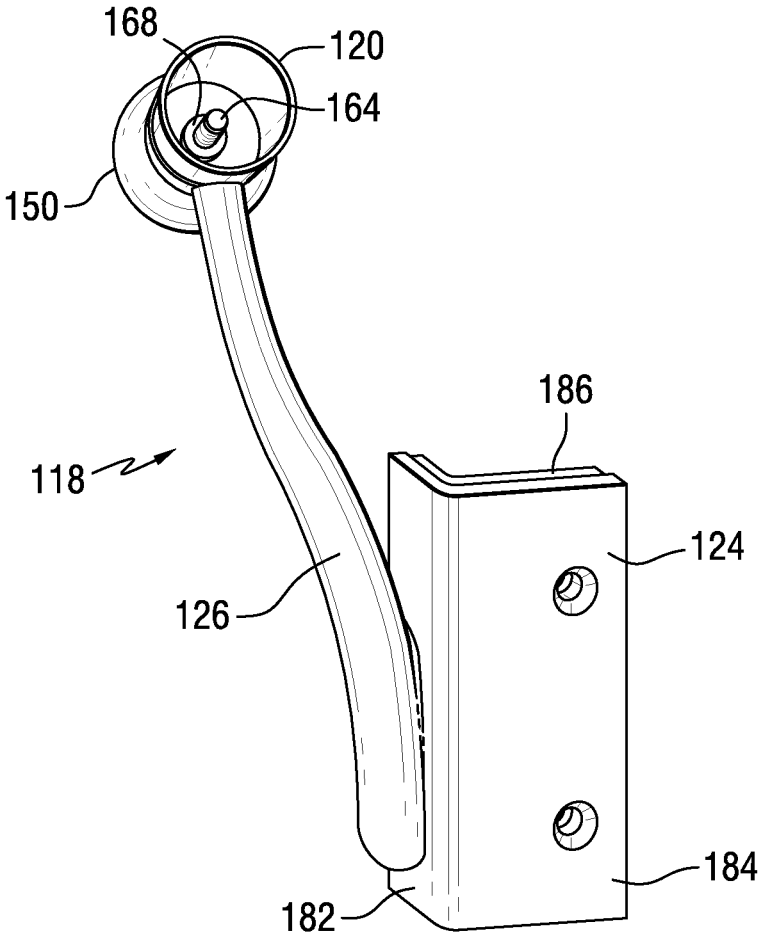
FIG. 13 is a schematic view of elements of the left support assembly of the window rod of FIG. 9.

FIG. 13 is an isometric view of the support assembly 118 showing that the bracket 124 has an "L" shaped cross-section, with a first part 182 configured to be positioned adjacent to a wall or casing adjacent to a window opening, and a second part 184 oriented substantially perpendicular to the first part and configured to be positioned adjacent to an interior wall of a window opening or window casing. This configuration resists twisting forces applied to the bracket due to the weight of the support rod and a curtain mounted on the support rod. A resilient pad 186 is provided on the interior surfaces of the bracket to protect the wall or casing and to provide an interface with the wall or casing.

Figure 14:
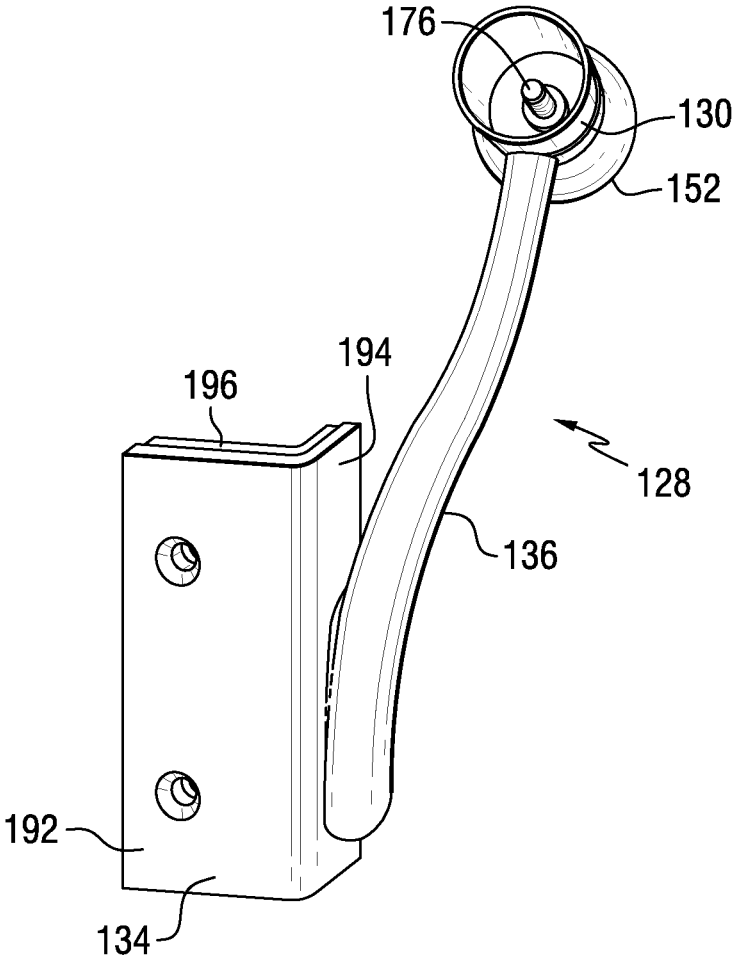
FIG. 14 is a front view of another window rod in accordance with an embodiment of the invention.

FIG. 14 is an isometric view of the support assembly 118 showing that the bracket 134 has an "L" shaped cross-section, with a first part 192 configured to be positioned adjacent to a wall or casing adjacent to a window opening, and a second part 194 configured to be positioned adjacent to an interior wall of a window opening or window casing. This configuration resists twisting forces applied to the bracket due to the weight of the support rod and a curtain mounted on the support rod. A resilient pad 196 is provided on the interior surfaces of the bracket to protect the wall or casing and to provide an interface with the wall or casing.

Figure 15:
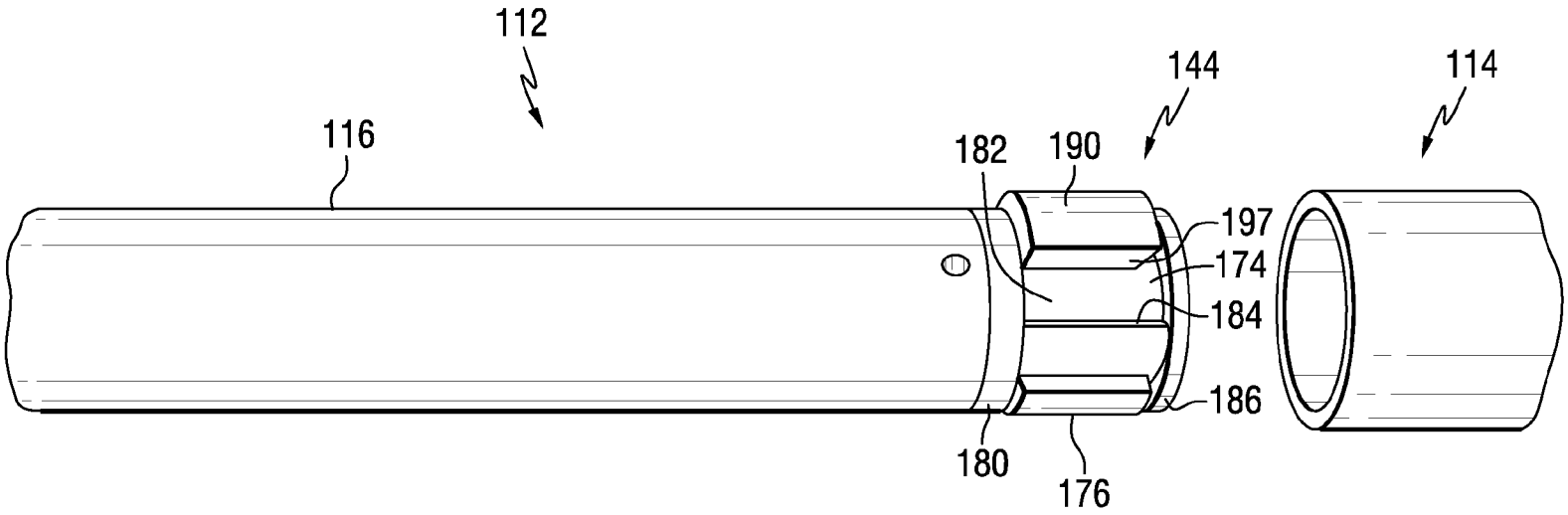
FIG. 15 is a side view, of a torsional locking mechanism for securing the position of a second rod section with respect to a first rod section in accordance with an embodiment of the present invention.

FIG. 15 shows a locking mechanism 144 configured to be positioned within rod section 114 and adjacent to the end of rod section 116. The locking mechanism includes a cam and sleeve configured such that rotation of the first section with respect to the second section causes the locking mechanism to fix the axial position of the first rod section with respect to the second rod section. The locking mechanism can be, for example, the locking mechanism shown in US Patent Application Publication No. 2013/0112639.

FIG. 15 is a side view of portions of the rod 112 of FIG. 9. The rod includes a first section 114 and a second section 116 having a slightly smaller outer diameter than the inner diameter of the first rod section 114. The second rod section 116 is axially movable with respect to the first rod section 114. The first and second rod sections may be made of any suitable material, such as metal or the like. A substantially cylindrical bushing 176 made of plastic or other suitable material is configured to be inserted inside the end of the first rod section 114 within a portion of the rod section 114 surrounding a portion of the second rod section 116. The bushing is configured to make contact with the internal surface of the rod section 114 and is positioned over a cam such that when the rod sections 114 and 116 are rotated with respect to each other, the bushing is forced against the internal surface of rod section 114 and the axial positions of rod sections 114 and 116 are locked with respect to each other.

The locking mechanism 144 mounted on the end of the second rod section 116 is configured to be positioned inside the stationary tube 114 when the pole 112 is assembled. The locking mechanism 144 includes a locking cam head 174 that is offset with respect to the central axis of the rod. A bushing 190 (also called a cam locking sleeve) is positioned on the cam head between an annular flange 180 and a support flange 186. The bushing has a varying thickness with a relatively thin end 176 and a relatively thick end 197. When the locking mechanism is inserted in rod section 114, rotation of the cam head forces the bushing into the internal surface of rod section 114 and thereby fixes the axial position of rod section 114 with respect to rod section 116.

The locking cam head 174 includes the annular flange 180 and an end flange 186. The locking head 174 includes two cam surfaces 182 extending between the annular flange 180 and end flange 186 having non-circular, helical or spiral surfaces. One of the cam surfaces 182 is shown in FIG. 15, with the other cam surface located 180° around the circumference of the locking head 174. The locking head 174 includes two stop surfaces 184 extending between the annular flange 180 and end flange 186. Each stop surface 184 lies substantially in a plane extending radially outward from the central axis of the locking head 174 and defining an interruption or transition between each of the cam surfaces 182.

Figure 16:
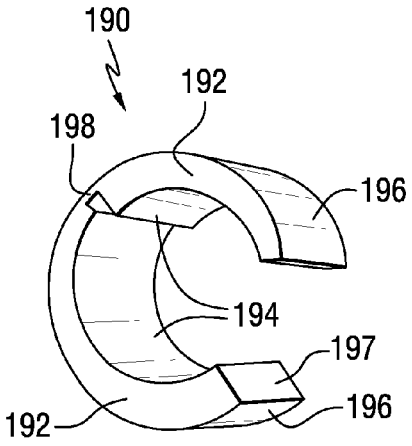
FIG. 16 is an isometric view of the locking cam sleeve of FIG. 15.
Figure 17:
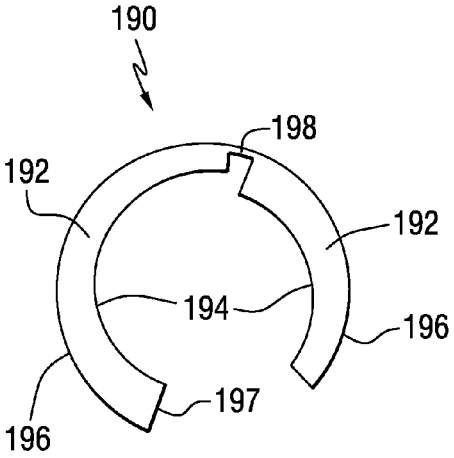
FIG. 17 is an end view of a locking cam sleeve.

As shown in FIG. 15, a locking cam sleeve 190 is mounted on the locking head 174 between the annular flange 180 and end flange 186. As shown in FIGS. 16 and 17, the locking cam sleeve 190 includes two cam members 192, each of which has an inner cam surface 194, an outer contact surface 196 and a stop edge 197. The cam members 192 are connected together by a thin web 198. The locking cam sleeve 190 may be made of any suitable flexible or elastomeric material such as natural rubber, synthetic rubber, flexible plastic or the like. The locking cam sleeve 190 preferably has a relatively high friction coefficient in order to help secure the second rod section 116 in a selected axial position with respect to the first rod section 114, as more fully described below.

The locking mechanism 144 operates as follows. The locking cam sleeve 190 is initially located in a radially retracted position on the locking cam head 174 in which the stop edges 197 of the sleeve 190 are in contact or adjacent to the corresponding stop surfaces 184 of the locking head 174. The thicker portions of the cam members 192 are adjacent to the radially recessed portion of the cam surfaces 182. In this radially retracted position, the second rod section 116 is free to move axially with respect to the first rod section 114.

During installation, the second rod section 116 is positioned in the first rod section 114 to a desired position in which the brackets are in initial contact positions against the supporting surfaces of the window opening or window casing. In this position, the second rod section 116 is then twisted around its longitudinal axis, which rotates the locking mechanism inside the first rod section 114. Upon such a twisting motion, the outer contact surfaces 196 of the locking cam sleeve 190 contact the inner surface of the first rod section 114 and frictional forces therebetween hold the locking cam sleeve 190 in a stationary position with respect to the first rod section 114, i.e., the locking cam sleeve 190 does not rotate inside the rod 114 with the remainder of the torsional locking mechanism. As the locking cam head 174 rotates inside the first rod section 114 with the locking cam sleeve 190 remaining in position, the inner cam surfaces 194 of the locking cam sleeve 190 slide in a generally circumferential direction on the cam surfaces 182 of the locking cam head 174. Due to this relative movement, the cam members 192 move radially outward and press against the inner surface of the first rod section 114 with sufficient force to lock the cam head 174 into position within the first rod section 114. Thus, the second rod section 116 and first rod section 114 are held in position with respect to each other.

With the locking mechanism 144 in the locked position, at least one force adjusting mechanism is used to place an outward force on the support arm. That is, at least one of the finials 150, 152 may be rotated with respect to the pole 112, causing a threaded stud to engage a threaded opening in an end of the support rod, thereby lengthening the support rod and consequently forcing the brackets against the supporting surfaces. This securely mounts the rod assembly between the supporting surfaces of the window opening or window casing.

Figure 18:
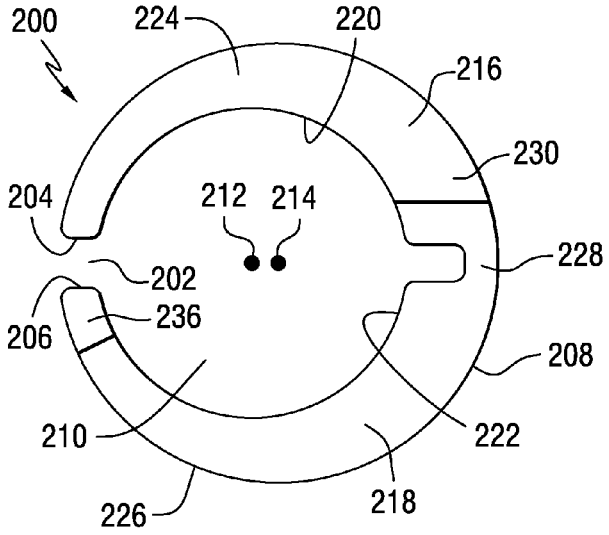
FIG. 18 is an end view of a locking cam sleeve.
Figure 19:
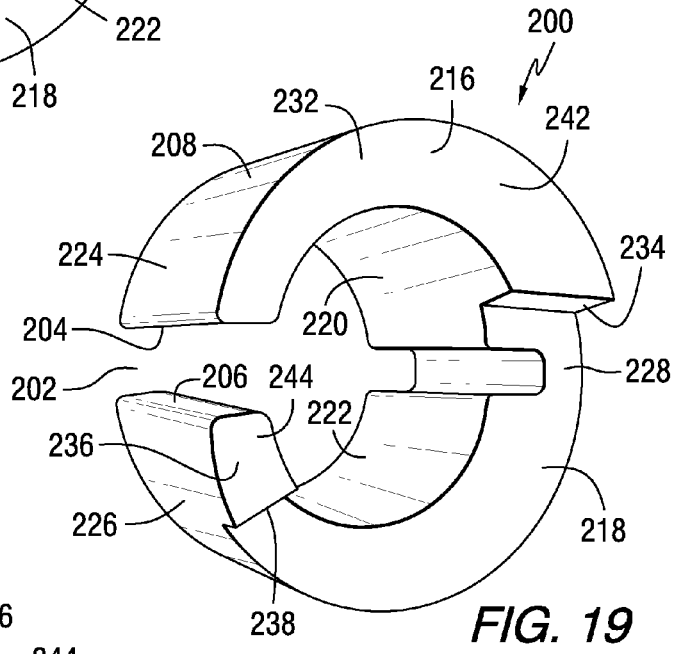
FIG. 19 is an isometric view of the locking cam sleeve of FIG. 18.
Figure 20:
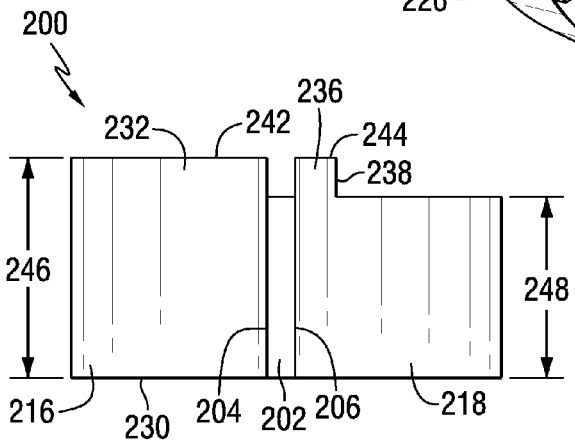
FIG. 20 is a side view of the locking cam sleeve of FIG. 18.

FIG. 18 is an end view of another locking cam sleeve 200. FIG. 19 is an isometric view of the locking cam sleeve of FIG. 18. FIG. 20 is an elevation view of the locking cam sleeve of FIG. 18. The flexible locking cam sleeve 200 includes a slit 202 between ends 204 and 206. When the ends 204 and 206 are pushed together to touch each other, the locking sleeve has a generally cylindrical outer surface 208 and is shaped to define a generally cylindrical opening 210 having an axis 212 that is offset from an axis 214 of the generally cylindrical outer surface 208. The flexible locking cam sleeve 200 includes two cam portions 216, 218, each of which has an inner cam surface 220, 222, an outer contact surface 224, 226. The cam portions 216, 218 are connected together by a thin web 228. The end 230 shown in FIG. 18 forms a planar surface.

As shown in FIG. 19, at least a part of cam portion 216 includes a raised portion 232 that forms a stop 234. Cam portion 218 includes a raised portion 236 that forms a stop 238. The space 240 between stops 234 and 238 is recessed with respect to the top surfaces 242, 244 of raised portions 232 and 236. In addition, top surfaces 242 and 244 lie in a common plane. As shown in FIG. 20, the width 246 of cam portion 216 is larger than the width 248 of cam portion 218. The locking cam sleeve 200 may be made of any suitable flexible or elastomeric material such as natural rubber, synthetic rubber, flexible plastic or the like. The locking cam sleeve 200 preferably has a relatively high friction coefficient in order to help secure the second rod section 116 in a selected axial position with respect to the first rod section 114, as more fully described below.

Figure 21:
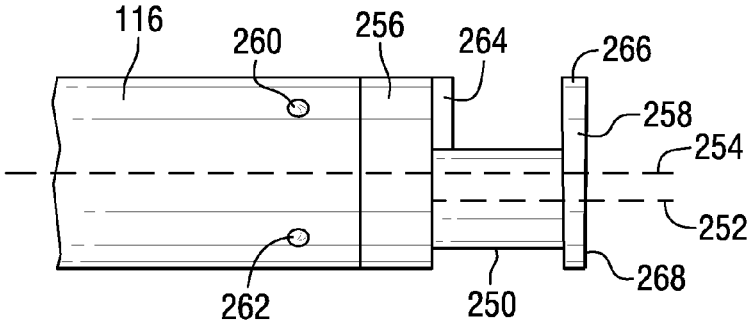
FIG. 21 is a side view of a portion of a torsional locking mechanism.

FIG. 21 is a side view of elements of another locking mechanism. FIG. 21 shows a cylindrical pin 250 having a central axis 252 that is offset from a central axis 254 of rod 116. The pin extends between a hub 256 and a disk 258. The outside surfaces of hub 256 and disk 258 lie on a common cylinder. The hub includes a portion, not shown in this view, that extends into rod 116 and is secured in the rod 116 by, for example, indents (or spot welds) 260, 262. A tab 264 extends from the hub. Tab 264 extends in a radial direction from the pin 250. When the locking cam sleeve 200 is positioned on the pin 250, the tab 264 is positioned in a space 240 between the stops 234 and 238. The width of the disk 258 has a slight taper such that the portion 266 of the disk opposite the tab is thicker than the rest of the disk. Thus the distance between that portion 266 of the disk and the hub is smaller than the distance between the bottom portion 268 of the disk and the hub. This feature ensures engagement of the tab and the stops on the locking cam sleeve.

Figure 22:
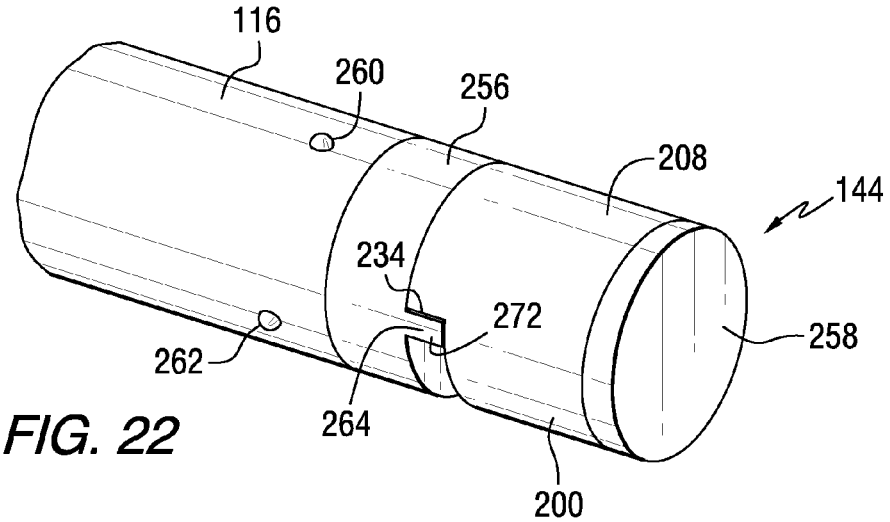
FIGS. 22 and 23 are isometric views of a locking cam mechanism including the elements of FIG. 21.
Figure 23:
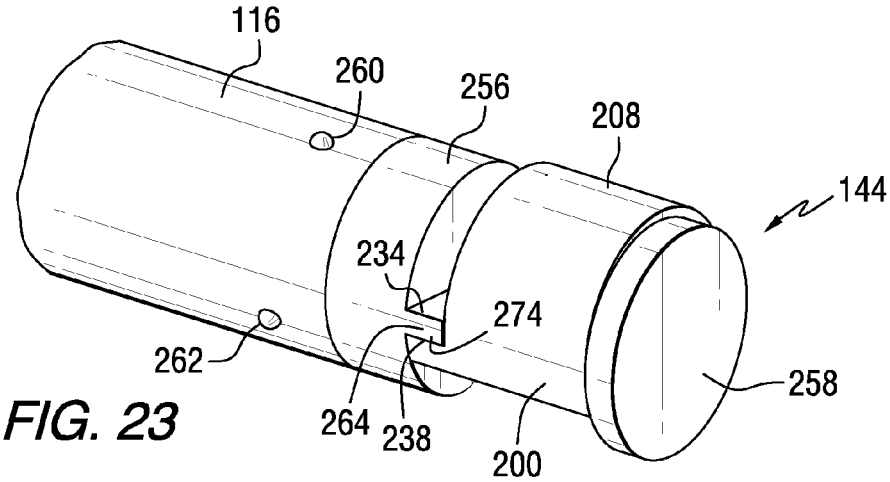

FIGS. 22 and 23 are isometric views of a locking mechanism 144 that includes the elements of FIGS. 18-21. FIGS. 22 and 22 illustrate a torsional locking mechanism 144 for locking the first rod section 114 and second rod section 116 together in a desired position in accordance with an embodiment of the invention. Although not shown in FIGS. 22 and 23, the torsional locking mechanism 144 mounted on the end of the second rod section 116 is positioned inside the first rod section 114 when the support rod 112 is assembled. FIG. 22 shows the locking mechanism with a first surface 272 of tab 264 adjacent to stop 234 on the locking sleeve. In this position, the outer surface 208 of the locking cam sleeve is positioned close to the cylinder containing the hub and disk such that the outer surface 208 slidably engages the inner surface of the first rod section 114. FIG. 23 shows the locking mechanism with a second surface 274 of tab 264 adjacent to stop 238 on the locking sleeve. In this position, the outer surface 208 of the locking cam sleeve is forced outward such that the outer surface 208 securely engages the inner surface of the first rod section 114.

The locking mechanism 144 operates as follows. The locking cam sleeve 200 is initially located in a radially retracted position on the pin 250 in which the stop 234 of the sleeve 200 is in contact with or adjacent to the first surface 272 of tab 264. In this radially retracted position, the second rod section 116 is free to move axially with respect to the first rod section 114.

The illustrated decorative tension window rods use an outward force on the brackets to hold the rods in place and do not require screws or adhesive. The rod assemblies eliminate the need for screwing a decorative rod to a wall or window casing and yet still include a decorative look of including finials, without damaging the window opening walls or casing. The support arm assemblies can be configured such that the arms extend forward into the room and can also be angled away from the window opening allowing the decorative finials to be positioned outside of the window opening and curtains attached to the support rod can then overlap the walls or casing adjacent to the window opening.

The rods, brackets, arms and fasteners may be made from any suitable materials such as metals. The brackets positioned on the top inside of the window opening may have a rubber or soft plastic base which then grips the inside of the window frame. The support rod, which can be positioned outside and above the window, can be initially locked in position using allen screws or the like, then the tension adjuster is used to apply tension into the arms/brackets which forces the brackets into the wall of the window opening (i.e., support surfaces) to hold the rod in place.

The rod can be finished with decorative hardware/finials that are commonly used on window rods. Further, if a person wishes to move the rod, it can be done easily and without damage to the window opening walls or casing.

Features of the various embodiments can be combined with each other to form addition embodiments. For example, the locking mechanism of FIG. 2 can be used in place of, or addition to the twist locking mechanism of FIGS. 15-23, in the embodiment of FIGS. 9-14.

Whereas particular embodiments of this invention have been described above for purposes of illustration, it will be evident to those skilled in the art that numerous variations of the details of the present invention may be made without departing from the invention as defined in the appended claims.

What is claimed is:

1. A window rod assembly comprising:

a first support arm assembly including a first bracket, a first support arm having a first end rigidly connected to the first bracket, and a first tube rigidly connected to a second end of the first support arm;

a second support arm assembly including a second bracket, a second support arm having a first end rigidly connected to the second bracket, and a second tube rigidly connected to a second end of the second support arm;

a curtain rod including a first rod section and a second rod section configured in a telescoping arrangement with a portion of the first rod section being sized to fit into the first tube and a portion of the second rod section being sized to fit into the second tube;

a locking mechanism for securing the relative axial position of the first rod section with respect to the second rod section; and a force adjusting mechanism mounted on the first support arm assembly and configured to apply an inward force to the curtain rod at a location within the first tube and an outward force to the first and second support arm assemblies to force the first and second brackets into support surfaces of a window opening or window casing.

2. The window rod assembly of claim 1, wherein the force adjusting mechanism comprises:

a first threaded stud positioned within the first tube, in a fixed axial location with respect to the first tube, and coupled to a first finial such that rotation of the first finial causes rotation of the first threaded stud;

a first threaded opening in a first end of the curtain rod configured to engage threads on the first threaded stud whereby rotation of the first threaded stud within the first threaded opening causes axial movement of the curtain rod within the first tube.

3. The window rod assembly of claim 1, wherein the first bracket includes a first surface and a first resilient pad adjacent to the first surface; and the second bracket includes a second surface and a second resilient pad adjacent to the second surface.

4. The window rod assembly of claim 1, wherein the first bracket includes a first part and a second part, the first part configured to be positioned adjacent to a first interior surface of an opening and the second bracket includes a first part and a second part, the first part configured to be positioned adjacent to a second interior surface of the opening.

5. The window rod assembly of claim 4, further comprising:

a resilient backing material adjacent to each of the first and second parts of each bracket.

6. The window rod assembly of claim 4, wherein the first and second parts of each bracket are oriented in planes that are at a right angle with respect to each other.

7. The window rod assembly of claim 1, wherein each of the support arms is welded to one of the brackets.

8. The window rod assembly of claim 1, wherein each of the brackets comprises:

first and second plates oriented at a substantially right angle with respect to each other, wherein one of the support arms is coupled to one of the plates of each bracket.

9. The window rod assembly of claim 1, wherein the locking mechanism comprises a locking cam head mounted on the second rod and structured and arranged to engage an inner surface of the first rod to thereby secure the second rod in a selected axial position with respect to the first rod, the locking cam head including a locking cam sleeve surrounding at least a portion of a pin having an axis offset from a longitudinal axis of the second rod, wherein rotation of the second rod around a longitudinal axis thereof causes the pin to move the locking cam sleeve radially outward to thereby force an outer contact surface of the locking cam sleeve against the inner surface of the first rod.

10. The window rod assembly of claim 9, wherein the locking cam sleeve comprises an elastomeric material.

11. The window rod assembly of claim 9, wherein the pin has a cylindrical surface.

* * * * *